US007359652B2

(12) United States Patent
Kodama et al.

(10) Patent No.: US 7,359,652 B2
(45) Date of Patent: Apr. 15, 2008

(54) IMAGE FORMING APPARATUS WITH TONE CORRECTION AND CONTROL METHOD THEREOF

(75) Inventors: Hirokzu Kodama, Ryugasaki (JP); Kazuhisa Koizumi, Abiko (JP)

(73) Assignee: Canon Kabushiki Kaisha (JP)

( * ) Notice: Subject to any disclaimer, the term of this patent is extended or adjusted under 35 U.S.C. 154(b) by 77 days.

(21) Appl. No.: 11/295,226

(22) Filed: Dec. 6, 2005

(65) Prior Publication Data

US 2006/0120742 A1 Jun. 8, 2006

(30) Foreign Application Priority Data

Dec. 7, 2004 (JP) ..... 2004-354699

(51) Int. Cl.
*G03G 15/00* (2006.01)
*G03G 15/10* (2006.01)

(52) U.S. Cl. ..... 399/49; 399/60; 399/72

(58) Field of Classification Search ..... 399/49, 399/223, 252, 60, 72

See application file for complete search history.

(56) References Cited

U.S. PATENT DOCUMENTS 6,879,788 B2 * 4/2005 Nagase et al. ..... 399/49

FOREIGN PATENT DOCUMENTS

| | | | |
|---|---|---|---|
| JP | 9-171279 | A | 6/1997 |
| JP | 2001-191589 | A | 7/2001 |
| JP | 2004-93643 | A | 3/2004 |
| JP | 2004-145137 | A | 5/2004 |

OTHER PUBLICATIONS

Office Action issued in corresponding Japanese Application No. 2004-354699, dated Jul. 27, 2007.

* cited by examiner

*Primary Examiner*—Hoang Ngo
(74) *Attorney, Agent, or Firm*—Rossi, Kimms & McDowell, LLP

(57) ABSTRACT

A first pattern is formed on a recording medium using a dark color substance and light color substance with substantially the same hue by supplying first pattern data to an image forming unit, and the density of the pattern is detected. If a variation in the detected density of the first pattern is not less than a predetermined value, conditions for image forming using the dark color substance and light color substance with the same hue in the image forming unit are corrected on the basis of the density of the first pattern and that of the first pattern data.

8 Claims, 15 Drawing Sheets

IMAGE FORMING APPARATUS WITH TONE CORRECTION AND CONTROL METHOD THEREOF

FIELD OF THE INVENTION

The present invention relates to an image forming apparatus which forms an image by an electrophotographic method and a control method of the image forming apparatus.

BACKGROUND OF THE INVENTION

Along with technical progress in an image forming apparatus such as a copying machine, requirements for an image formed by such an image forming apparatus have been increasing. In response to such a growth in the needs of users, there is a commercially available image forming apparatus having developing substances of an increased number of colors and using an electrophotographic method, which is in contrast to a conventional image forming apparatus which forms an image using developing substances of four colors (Y (yellow), M (magenta), C (cyan), and Bk (black)). These apparatuses include ones which handle special colors such as red, blue, green, gold, silver, and fluorescent colors in addition to four common conventional colors of cyan, magenta, yellow, and black, ones of inkjet type which additionally use light cyan, light magenta, and the like, and various others. The use of developing substances of multiple colors makes it possible to reproduce more natural colors than those of an image formed by a conventional image forming apparatus.

As an image forming apparatus of this type, there is commonly used one which uses six developing substances including cyan, magenta, yellow, and black developing substances, and light cyan and light magenta developing substances containing pigments which have spectral characteristics equivalent to those of pigments contained in the cyan and magenta developing substances and are smaller in amount. In the following explanation, the cyan and magenta developing substances will be referred to as dark toners while the light cyan and magenta developing substances will be referred to as light toners.

FIG. 10 is a graph for explaining the density of input image data (density of image data), the density of a printed image (optical density), and the amount of adhering toner.

In FIG. 10, the characteristics indicated by solid lines show the adhesion amounts of the dark toners and light toners on a recording sheet with respect to an image density in an image forming apparatus using the dark toners and light toners. A characteristic indicated by a straight line 1000 is the characteristic of an ideal optical density with respect to the density of image data.

The adhesion amounts of the light and dark toners with respect to the image density are determined such that the optical density of an image formed using the light and dark toners is plotted to be ideally linear. As shown in FIG. 10, in an area extending from a low-density portion (highlight portion) to a medium-density area with a density of "0.9" or less, an image is formed using only the light toners in order to reduce the granulated effect of the image. In an area extending from the medium-density area to a high-density area, the dark toners are additionally used to suppress the amount of toner applied, and an image is formed using the light and dark toners.

In such an apparatus, the characteristic of an optical density varies depending on the environment and conditions in which the apparatus operates. For example, if the amounts of adhering dark toners have a characteristic as indicated by a curved line 1002 in FIG. 10, the optical density characteristic is plotted as indicated by a curved line 1001, and the optical density rapidly changes in the medium-density area where the dark toners start to be used in image forming. Accordingly, in an image containing a medium-density area, the tone may be unnatural or a false outline may occur.

For this reason, a variation in tone in a medium-density area is prevented by performing tone correction (tone correction for the colors of the light and dark toners) at power-on, at regular time intervals, at a predetermined time in a case where a variation in tone occurs, or in accordance with a user's instruction (see, e.g., Japanese Patent Laid-Open No. 2004-145137).

In such tone correction, a test pattern is formed on a recording paper sheet using developing substances (toners) that are used for image forming, and the density of the formed test pattern is detected by a sensor. The density is compared with that of original pattern data, and the tone correction is performed for a formed image. However, an image forming apparatus which adopts the tone correction using the light and dark toners requires formation of three types of test patterns, i.e., a test pattern formed using only the dark toners, a test pattern formed using only the light toners, and a test pattern formed using both of the dark toners and light toners. This causes a problem in that tone correction prolongs the downtime of the apparatus and reduces the productivity.

SUMMARY OF THE INVENTION

The present invention has as its object to solve the problem with the prior art.

The invention of the present application has as its feature to provide an image forming apparatus which, if a variation in the density of a first pattern formed using a dark color substance and light color substance with substantially the same hue is equal to or larger than a predetermined amount, performs tone correction using the light and dark color substances, and a control method of the image forming apparatus.

According to an aspect of the present invention, there is provided with an image forming apparatus having an image forming unit which forms an image using a dark color substance and light color substance with substantially a same hue, comprising:

a pattern forming unit configured to form a first pattern on a recording medium using the dark color substance and light color substance with substantially the same hue by supplying first pattern data to the image forming unit;

a density detection unit configured to detect a density of the first pattern formed on the recording medium by the pattern forming unit;

a correction unit configured to correct conditions for image forming using the dark color substance and light color substance with substantially the same hue in the image forming unit, on the basis of the density of the first pattern detected by the density detection unit and a density of the first pattern data; and a control unit configured to perform control so as to perform correction by the correction unit, in a case where a variation in the density of the first pattern detected by the density detection unit is not less than a predetermined value.

Other features, objects and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will be explained below in detail with reference to the accompanying drawings. Note that the embodiments below are not intended to limit the present invention which is according to the claims, and that all combinations of features explained in these embodiments are not always essential to the solution of the present invention.

Figure 1:
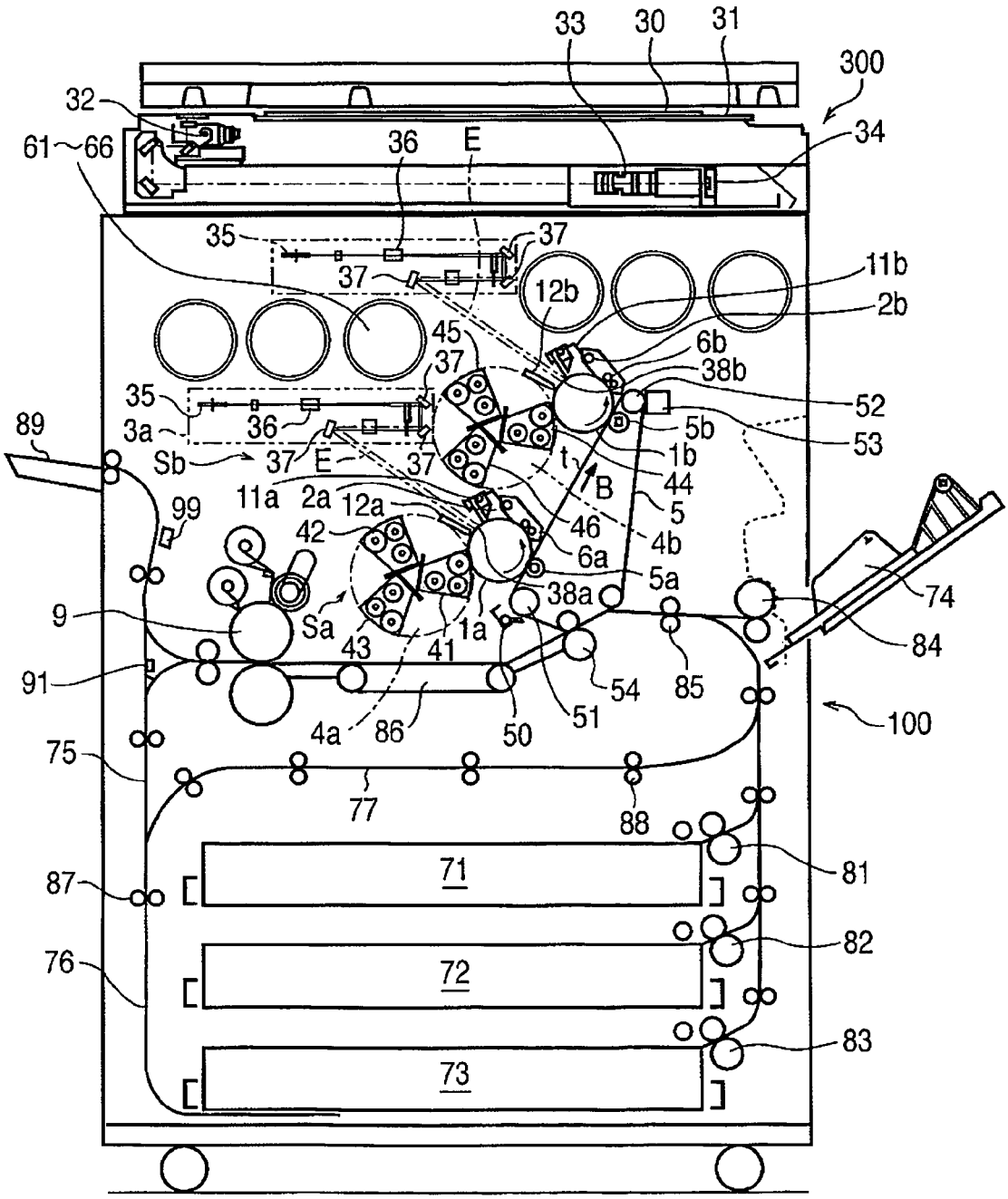
FIG. 1 depicts a view showing a schematic sectional view of a full-color image forming apparatus according to an embodiment of the present invention.

FIG. 1 depicts a view showing a schematic sectional view of a full-color image forming apparatus (to be referred to as a multi-function machine with a copy function, printer function, and facsimile function combined hereinafter) according to the embodiment. The multi-function machine has a color image reader unit 300 at the upper portion and a color image printer unit 100 at the lower portion.

In the reader unit 300, a document 30 having been placed face-down on an original plate 31 is subjected to exposure scanning by an exposure lamp 32. With this operation, an optical image reflected by the document 30 is focused on a CCD 34 by a lens 33, and color-separated image signals are obtained from the full-color CCD sensor 34. The color-separated image signals pass through an amplifier circuit (not shown) and undergo processing by a video processing unit (not shown). The image signals are sent out to the printer unit 100 through an image memory (not shown) and are printed by the printer unit 100.

Not only an image signal from the reader unit 300 but also an image signal from a computer, an image signal from a FAX, and the like is sent out to the printer unit 100. As a typical example, the operation of the printer unit 100 on the basis of an image signal from the reader unit 300 will be explained.

Roughly speaking, two image forming units, i.e., a first image forming unit Sa including a first photosensitive drum 1*a* and a second image forming unit Sb including a second photosensitive drum 1*b* are arranged in the printer unit 100. These image forming units Sa and Sb each have the same arrangement (shape) for the purpose of reducing costs. For example, developing units (to be described later) are almost the same in arrangement and shape. With this arrangement, the printer unit 100 can allow the interchange of developing units 41 to 46.

The two drum-like photosensitive bodies (photosensitive drums) serving as image carriers, i.e., the first photosensitive drum 1*a* and second photosensitive drum 1*b* are so held as to be rotatable in the directions indicated by respective arrows in FIG. 1. A pre-exposure lamp 11*a*, a corona charger (charging means) 2*a*, first exposing means 3*a* serving as a laser exposure optical system, a potential sensor 12*a*, a moving body (developing rotary) 4*a* serving as a rotary developing unit holder, three developing units 41 to 43 whose holders accommodate developing substances of different colors, a primary transfer roller 5*a* serving as primary transfer means, and a cleaning unit 6*a* are arranged around the first photosensitive drum 1*a*. Similarly, a pre-exposure lamp 11*b*, a corona charger 2*b*, second exposing means 3*b*, a potential sensor 12*b*, a moving body 4*b*, developing units 44 to 46, a primary transfer roller 5*b*, and a cleaning unit 6*b* are arranged around the second photosensitive drum 1*b*.

The number of developing units only needs to be five or more to achieve high image quality. In this embodiment, the six developing units 41 to 46 are used. As for the developing units 41 to 46, the developing unit 41 is loaded with magenta toner; the developing unit 42 is loaded with cyan toner; the developing unit 43 is loaded with light magenta toner; the developing unit 44 is loaded with yellow toner; the developing unit 45 is loaded with black toner; and the developing unit 46 is loaded with light cyan toner.

A dark color developing substance and light color developing substance are produced to contain pigments which have equivalent spectral characteristics and are different in amount. Accordingly, the pigment contained in the light magenta toner has spectral characteristics equivalent to that contained in the magenta toner but is smaller in amount. The pigment contained in the light cyan toner has spectral characteristics equivalent to that contained in the cyan toner but is smaller in amount. It is also possible to mount, in the developing rotaries 4*a* and 4*b*, a developing unit (with the same shape as those described above) which accommodates a toner containing a pigment with spectral characteristics different from those of the pigments contained in the cyan, magenta, yellow, and black toners, such as a metallic toner (e.g., gold or silver toner) or a fluorescent toner containing a fluorescent substance.

Each developing unit is loaded with a two-component developing substance which is a mixture of a toner and a carrier, but a one-component developing substance composed of a toner only may be used instead.

The use of dark and light color toners for each of magenta and cyan aims at remarkably improving the reproducibility of a light-colored image such as one of a human skin (reducing the granulated effect).

In each of the first and second exposing means 3*a* and 3*b*, an image signal from the reader unit 300 is converted into an optical signal by a laser output unit (not shown), the image signal having been converted into the optical signal, i.e., a laser light beam E is reflected by a polygon mirror 35. The laser light beam E passes through a lens 36 and reflecting mirrors 37 and is projected at an exposure position on the surface of a corresponding one of the photosensitive drums 1*a* and 1*b*.

At the time of image forming by the printer unit 100, the photosensitive drums 1*a* and 1*b* are rotated in directions indicated by arrows, respectively. The photosensitive drums 1*a* and 1*b*, from which electric charges have been removed by the pre-exposure lamps 11*a* and 11*b*, are uniformly charged by the corona chargers 2*a* and 2*b*. The photosensitive drums 1*a* and 1*b* are irradiated with optical images for respective separated colors, and latent images are formed on the photosensitive drums 1*a* and 1*b*, respectively.

The rotary developing unit holders serving as the moving bodies, i.e., the first developing rotary 4*a* and second developing rotary 4*b* are rotated to move the developing units 41 and 44 to a development portion on the photosensitive drum 1*a* shared by the developing units 41 to 43 and one on the photosensitive drum 1*b* shared by the developing units 44 to 46. After that, the developing units 41 and 44 are operated to reversely develop the electrostatic latent images on the photosensitive drums 1*a* and 1*b* and form developing substance images (toner images), each having a resin and a pigment as base substances, on the photosensitive drums 1*a* and 1*b*. At this time, a developing bias is applied to each developing unit.

As shown in FIG. 1, the toners in the developing units 41 to 46 are replenished at desired times from toner storage units (hoppers) 61 to 66 for the respective colors arranged between and beside the laser exposure optical systems 3*a* and 3*b*, so as to keep the toner ratio (or toner amount) in each developing unit.

The toner images formed on the photosensitive drums 1*a* and 1*b* are sequentially primarily transferred by the primary transfer rollers 5*a* and 5*b* serving as the primary transfer means onto an intermediate transfer body (intermediate transfer belt) 5 serving as a transfer medium such that the toner images are formed one on top of the other. At this time, a primary transfer bias is applied to each of the primary transfer rollers 5*a* and 5*b*. As a result, the toner images are sequentially overlaid one on top of the other on the intermediate transfer belt 5 to form a full-color toner image. After that, the full-color toner image on the intermediate transfer belt 5 serving as the transfer medium is secondarily transferred onto a paper sheet serving as a recording material. At this time, a secondary transfer bias is applied to a secondary transfer roller 54.

The intermediate transfer belt 5 is conveyed and driven by a driving roller 51, and a transfer cleaning device 50 is located at a position opposing the driving roller 51 across the intermediate transfer belt 5 so as to come into or out of contact with the driving roller 51. The photosensitive drums 1*a* and 1*b* are provided to a transfer surface which is a coplanar portion formed by stretching the intermediate transfer belt 5 between two rollers, the roller 51 and a roller 52. The primary transfer rollers 5*a* and 5*b* serving as the primary transfer means are provided at positions opposing these photosensitive drums 1*a* and 1*b* across the intermediate transfer belt 5.

A sensor 53 is arranged downstream in the moving direction of the intermediate transfer belt 5 forming the transfer surface at a position opposing the driven roller 52. The sensor 53 detects a positional shift of each of the images transferred from the photosensitive drums 1*a* and 1*b* and the density of the image. Control for each of the image forming units Sa and Sb is performed at any time using a detection signal by the sensor 53 so as to correct the image density, toner replenishment amount, timing of image writing, image writing start position, and the like. After overlaying of images of necessary colors on the intermediate transfer belt 5, the transfer cleaning device 50 opposing the driving roller 51 upstream in a direction B in which the intermediate transfer belt 5 performs conveyance, is pressurized by the opposing driving roller 51 to clean toner on the intermediate transfer belt 5 left after transfer onto a recording material. After the cleaning, the transfer cleaning device 50 is separated from the intermediate transfer belt 5.

Recording materials (recording sheets) are conveyed one by one from storage units 71 to 73 or a manual feed tray 74 by paper feed means 81 to 84, and a skew of each recording material is corrected by a pair of registration rollers 85. After that, each recording material is conveyed to a secondary transfer unit between the secondary transfer roller 54 and the intermediate transfer belt 5 serving as secondary transfer means, which transfers the toner image on the intermediate transfer belt 5 onto the recording material at a desired time. The recording material, onto which the toner image has been transferred by the secondary transfer roller 54, passes through a conveying unit 86, and the toner image is fixed by a heat roller fixing unit 9. After that, the recording material is delivered to a discharge tray 89 or a finisher (not shown).

The intermediate transfer belt 5 after secondary transfer undergoes cleaning of toner left after the transfer by the transfer cleaning device 50 as described above and is made available again for use in the primary transfer step by the image forming units Sa and Sb.

When images are to be formed on both sides of a recording material, a conveying path switching guide 91 is driven immediately after a recording material passes through the heat roller fixing unit 9. After the conveying path switching guide 91 temporarily guides the recording material to a reversing path 76 through a vertical conveying path 75, a reversing roller 87 rotates in the backward direction. With this operation, the recording material is made to retreat in a direction opposite to the direction in which the recording material is fed in with an edge having been the trailing edge at the time of the feeding first and is conveyed to a double-sided conveying path 77. After that, the recording material passes through the double-sided conveying path 77 and undergoes skew correction and timing adjustment by a double-sided conveying roller 88. The recording material is conveyed to the registration rollers 85 at a desired time, and an image is transferred onto the other side in the above-described image forming step.

Note that four density sensors 99 are arranged in parallel in a direction perpendicular to the direction in which a recording material is conveyed between the heat roller fixing unit 9 and the delivery tray 89. It is possible to simultaneously measure cyan, magenta, yellow, and black patterns on the recording sheet having undergone fixation in the heat roller fixing unit 9, as needed.

Figure 2:
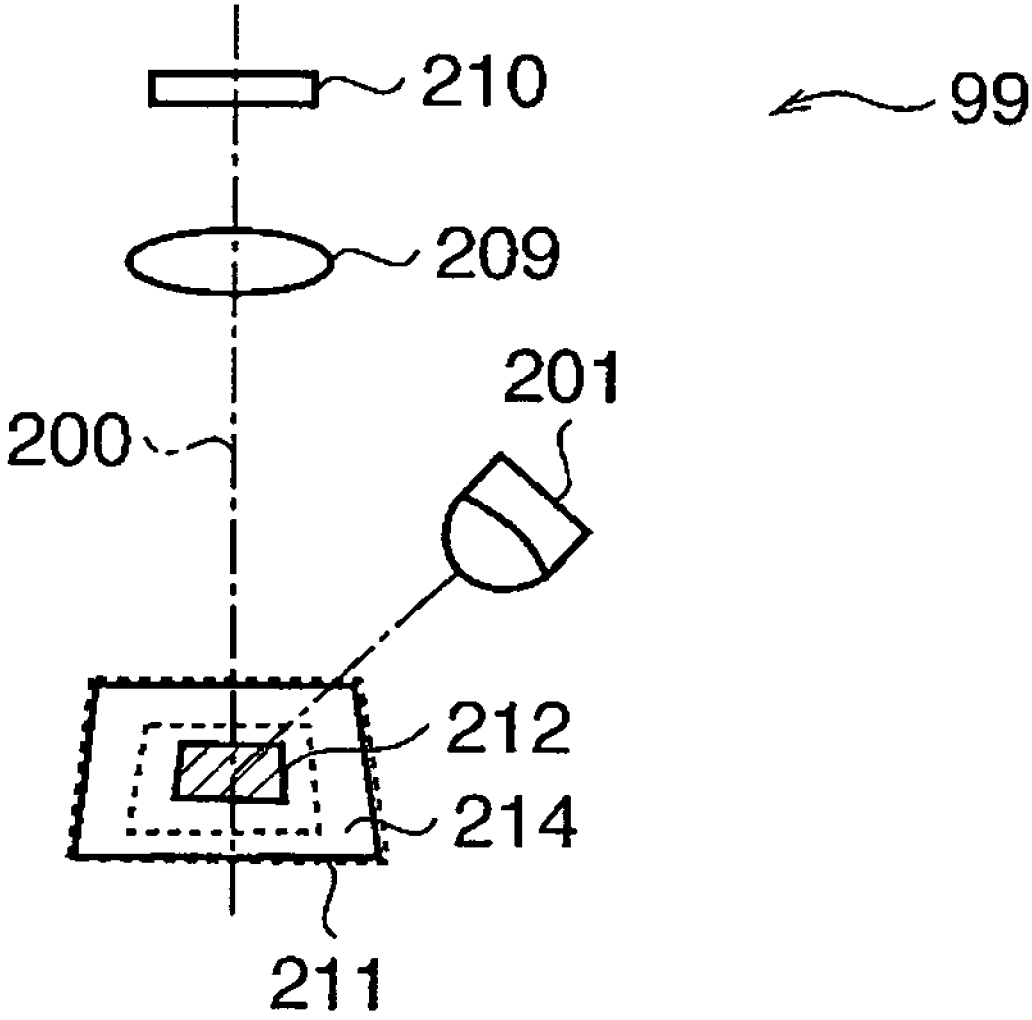
FIG. 2 depicts a view showing the detailed arrangement of a density sensor according to this embodiment and its surroundings.

FIG. 2 depicts a view showing the detailed arrangement of each density sensor 99 according to this embodiment and its surroundings.

An LED 201 whose emission peak wavelength varies from 400 nm to 700 nm depending on the color of a pattern to be measured is used as a light source of the density sensor 99. The LED 201 is arranged to be inclined at an angle of only 45° to a normal 200 of an opening 214 for measurement to irradiate a pattern 212 formed on a recording sheet conveyed to the opening 214 for measurement. An imaging lens 209 and light-receiving unit 210 are arranged on the normal 200 of the opening 214 for measurement. Of light reflected from the pattern 212 on the recording sheet irradiated by the LED 201, a component in the direction of the normal 200 is imaged on the light-receiving surface of the light-receiving unit 210 by the imaging lens 209. The light-receiving unit 210 is formed by arraying photoelectric conversion elements such as photodiodes.

Note that a recording surface glass 211 is placed between the density sensor 99 and the recording sheet. The recording sheet is conveyed so as to be in close contact with the recording surface glass 211, and measurement is performed while always keeping the optical path length from the sensor 99 to the recording sheet constant.

Figure 3:
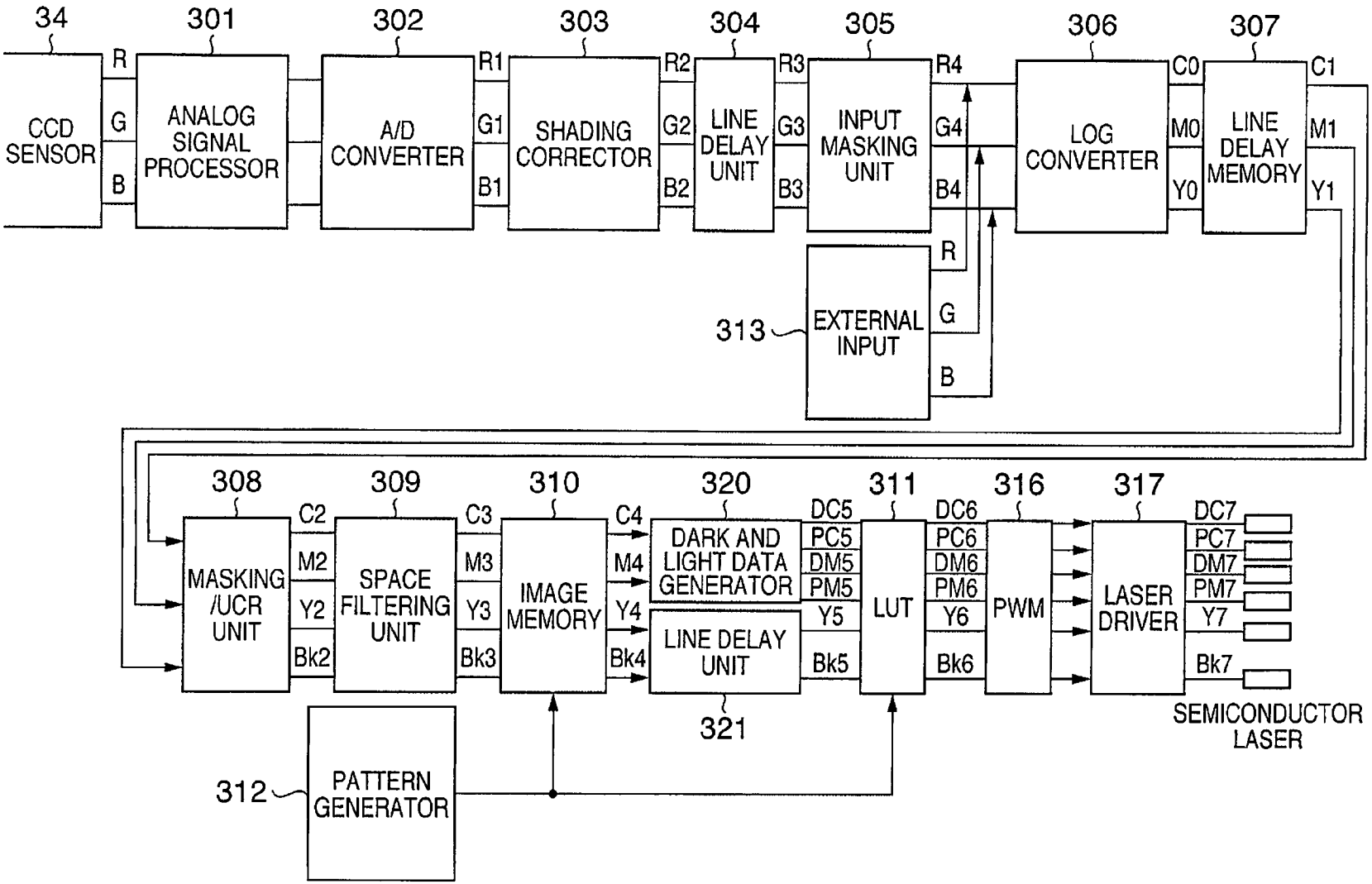
FIG. 3 is a block diagram showing the flow of image signals in an image processor of a reader unit and a printer controller in charge of the control of a printer unit according to the embodiment of the present invention.

FIG. 3 is a block diagram showing the flow of image signals in the image processor of the reader unit 300 and a printer controller in charge of the control of the printer unit 100 according to the embodiment of the present invention.

As shown in FIG. 3, image signals (R (red), G (green), and B (blue)) output from the CCD sensor 34 and a signal output from the density sensors 99 are input to an analog signal processor 301. After gain adjustment and offset adjustment in the analog signal processor 301, the image signals of the respective colors are converted into 8-bit digital image signals R1, G1, and B1 by an A/D converter 302. After that, the digital image signals are input to a shading corrector 303 and are subjected to publicly known shading correction (adjustment of white balance) for each color using a reference signal based on a reflected signal from a reference white plate. Since line sensors of the CCD sensor 34 are arranged at a predetermined distance from each other, a line delay circuit 304 corrects any spatial shift in the sub-scanning direction in the digital image signals. An input masking unit 305 converts a read color space determined by the spectral characteristics of R, G, and B filters of the CCD sensor 34 into the NTSC standard color space and performs a 3×3 matrix operation.

A light amount/density converter (LOG converter) 306 is composed of a lookup table (LUT) RAM and converts luminance signals R4, G4, and B4 into density signals Y0, M0, and C0. A masking and UCR circuit 308 extracts a black signal (Bk) from input signals Y1, M1, and C1 of three primary colors (delayed signals of the density signals Y0, M0, and C0 delayed by a line delay memory 307) and performs an operation to correct any color turbidity of recording color substances in the printer unit 100. The masking and UCR unit 308 sequentially outputs signals Y2, M2, C2, and Bk2 in a predetermined bit length (8 bits) every time reading operation is performed. A space filtering processor (output filter) 309 performs edge enhancement and a smoothing process. An image memory 310 temporarily stores signals Y3, M3, C3, and Bk3 having been processed in the above-described manner and sends out the signals to a dark and light data generator 320 and line delay unit 321 in sync with the image forming operation of the printer unit 100. The dark and light data generator 320 receives image data C4 and M4 and converts them into image data DC5 and DM5 for the dark toners and image data PC5 and PM5 for the light toners.

Figure 4:
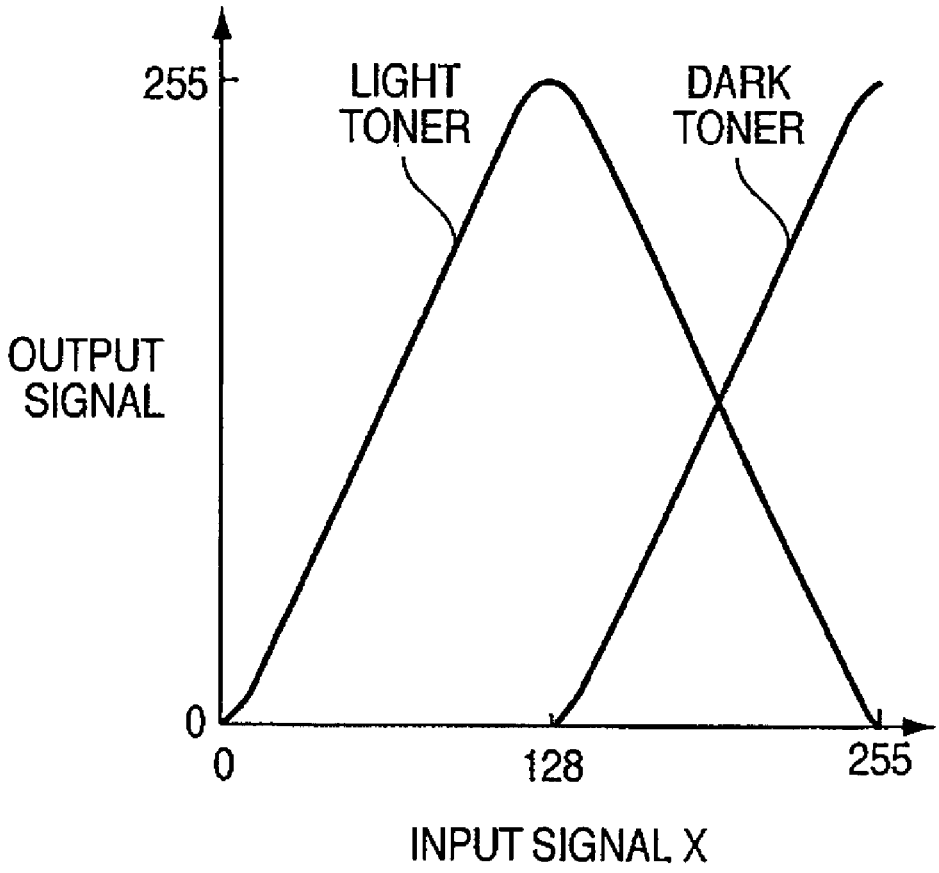
FIG. 4 is a graph for explaining density conversion characteristics in a dark and light data generator according to this embodiment.

FIG. 4 is a graph for explaining density conversion characteristics in the dark and light data generator 320 according to this embodiment. FIG. 4 shows output characteristics obtained when the dark and light data generator 320 receives an input image signal of cyan or magenta and outputs image signals corresponding to the dark toner and light toner. According to FIG. 4, in the case of an input signal in the range "0" to "128," an image is formed using only the light toner. In the case of an input signal in the range "128" to "255," the amount of the dark toner used increases with decreasing amount of the light toner used, and an image is formed using the dark toner and light toner.

The dark and light data generator 320 generates an image signal for the dark toner and one for the light toner based on the input image signal using such a conversion table. The conversion table varies depending on whether the input image is a tone image or character image. More specifically, in the case of a tone image, the light toners are used in larger amounts to reduce granulation in a highlight portion. In the case of a character image, the dark toners are used in larger amounts to limit the amount of toner to be applied. In this manner, the proportion of toners between image data for the dark toners and that for the light toners is changed.

In order to synchronize image data of respective colors to be input to a LUT 311 (to be described later), the line delay unit 321 performs timing adjustment to delay image data Y4 and Bk4 so as to keep pace with the image data DC5, PC5, DM5, and PM5 generated upon data conversion in the dark and light data generator 320. The LUT 311 performs density correction for signals so as to match the signals to the ideal gradation characteristic of the printer unit 100. Signals output from the LUT 311 are sequentially sent to a PWM unit 316. A laser driver 317 drives semiconductor lasers for the respective colors including the light colors to form latent images on the photosensitive drums 1*a* and 1*b*. Note that a pattern generator 312 for generating test pattern data is provided in the image forming apparatus.

Figure 5:
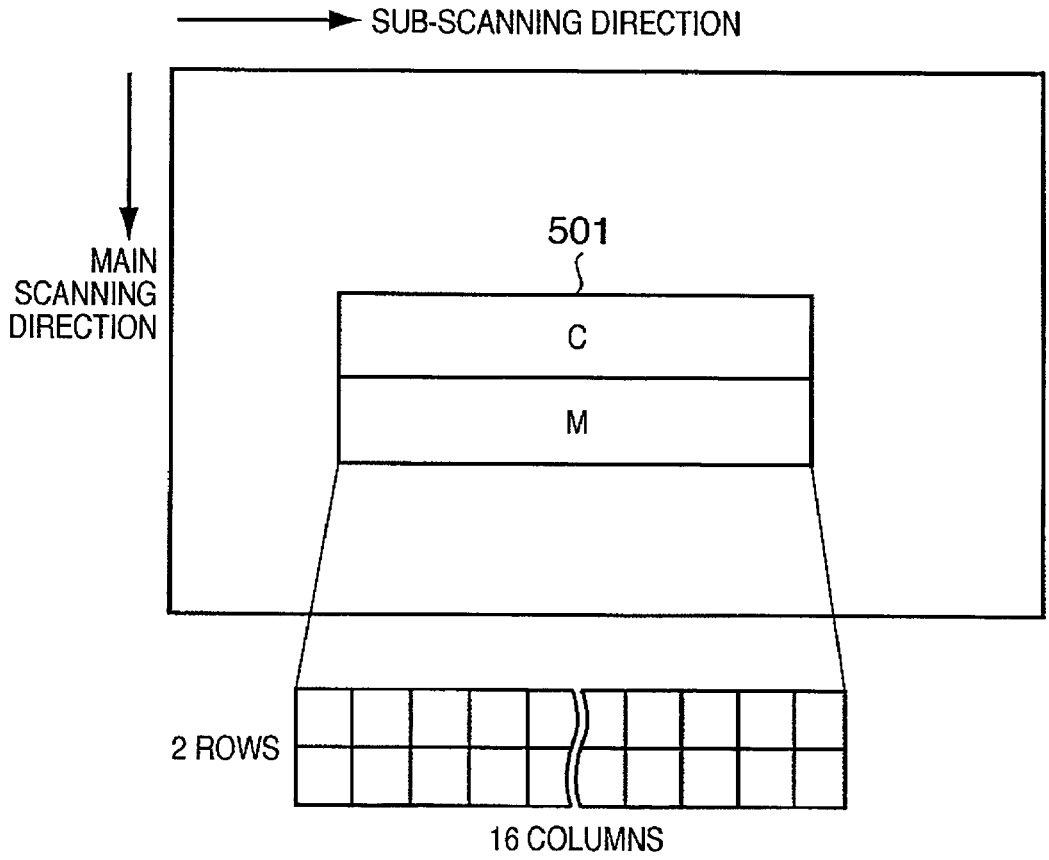
FIG. 5 is a chart for explaining a test pattern registered in a pattern generator according to this embodiment.

FIG. 5 is a chart for explaining a test pattern (to be simply referred to as a pattern hereinafter) registered in the pattern generator 312.

The pattern generator 312 can supply pattern data (test pattern data) to the dark and light data generator 320, line delay unit 321 via the image memory 310, and supply to the PWM unit 316 through the LUT 311 (in this case, the LUT 311 does not convert the pattern data). This makes it possible to output, as pattern data, a pattern having undergone conversion in the dark and light data generator 320 and LUT 311 and a pattern not having undergone conversion in the dark and light data generator 320 and LUT 311. Image signals DC6, PC6, DM6, PM6, Y6, and Bk6 having been processed in this manner are sent to the PWM unit 316.

A method of performing tone correction for the colors of the light and dark toners of cyan and magenta in the image forming apparatus using the light and dark toners according to this embodiment will be explained using a flowchart in FIG. 6.

Figure 6:
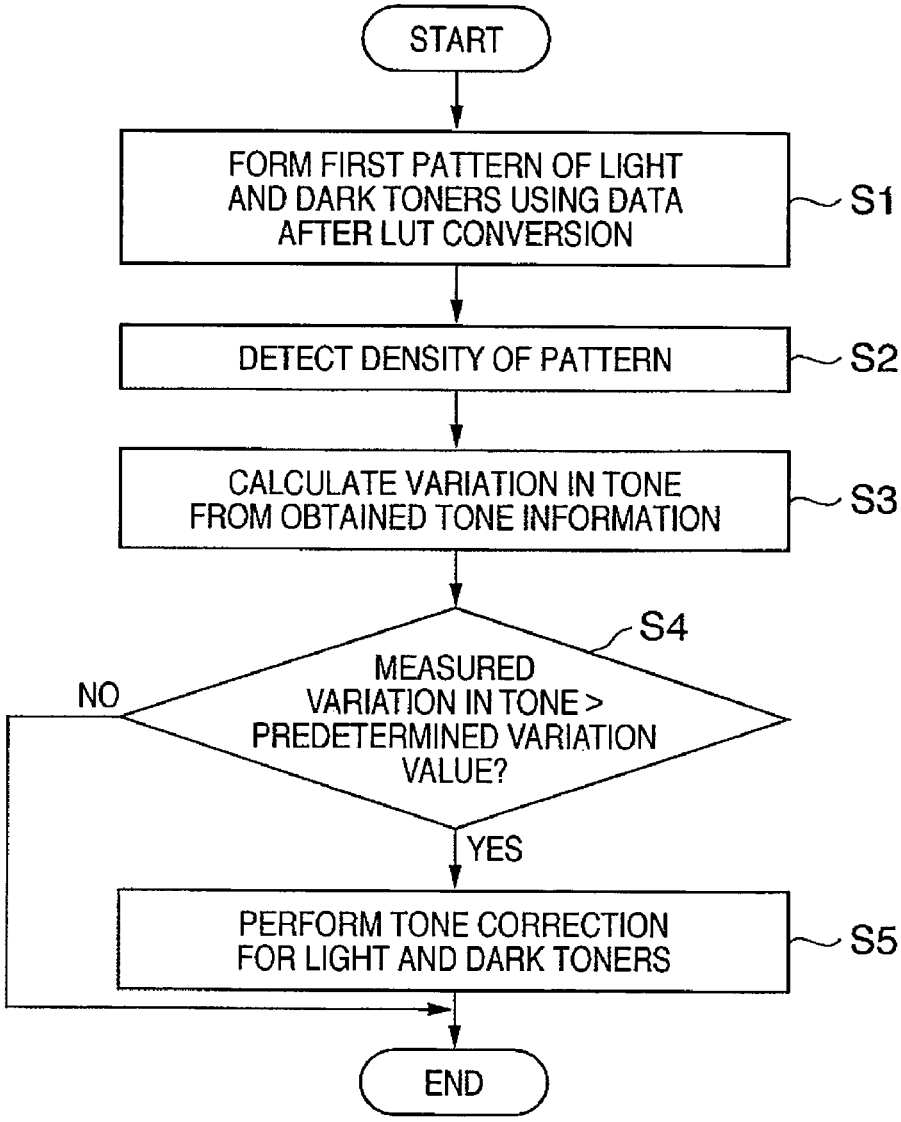
FIG. 6 is a flowchart for explaining the process of performing tone correction for an image of light and dark toners in the image forming apparatus according to this embodiment.

FIG. 6 is a flowchart for explaining the process of performing tone correction for an image of the light and dark toners in the image forming apparatus according to this embodiment.

The process starts when a predetermined time comes (e.g., at power-on, at regular time intervals, or when a variation in tone is expected to occur). First, in step S1, first pattern data is output from the pattern generator 312 to the image memory 310, and a first pattern 501 of the light and dark toners as shown in FIG. 5 is formed on a recording sheet using the data having undergone conversion in the dark and light data generator 320 and LUT 311. The pattern is formed using magenta (M) and cyan (C) for each of which light and dark toners are prepared. The pattern is formed using 16 (16-tone-level) input signals having equally spaced values (X=16, 32, 48, 64, . . . ) obtained from a 256-tone-level input image signal X. The first pattern 501 thus formed on the recording sheet is read by the density sensors 99 arranged downstream of the heat roller fixing unit 9 or is temporarily output to the delivery tray 89, placed on the original plate of the reader unit 300, and read by the CCD sensor 34 of the reader unit 300 (step S2).

Figure 7:
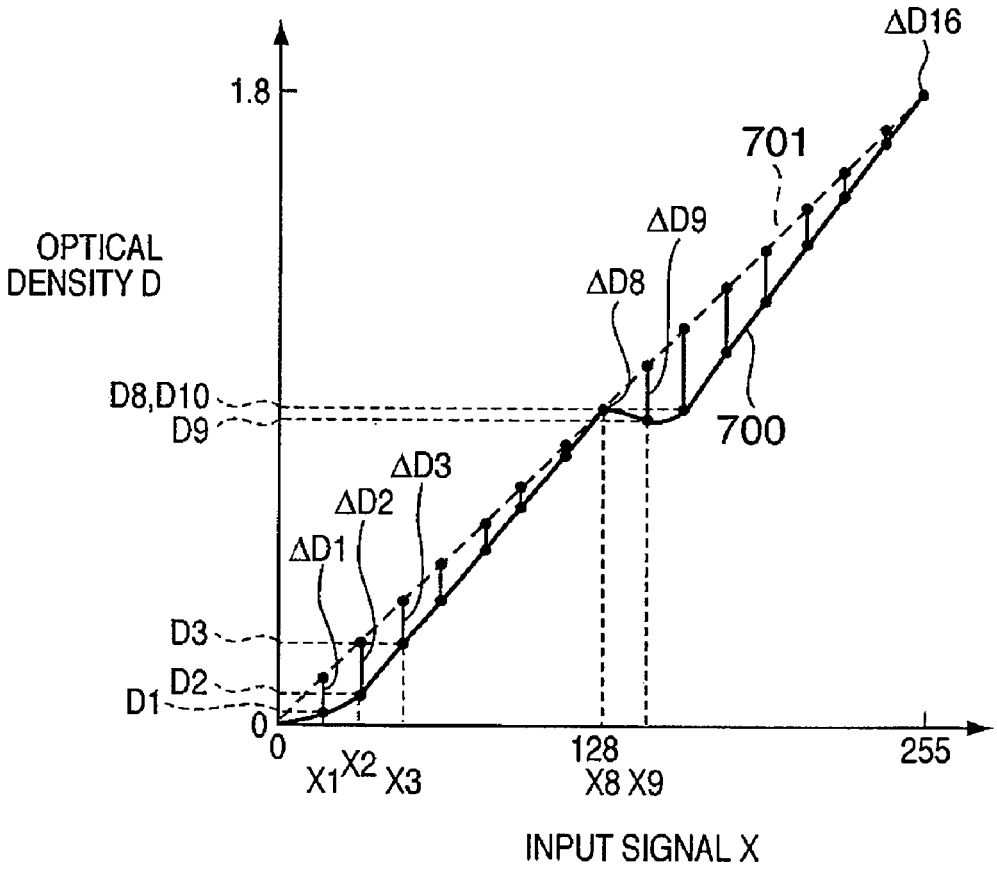
FIG. 7 is a graph for explaining the characteristic of an optical density D with respect to an input image signal X.

FIG. 7 is a graph for explaining the characteristic of an image density D formed with respect to an input image signal X.

In FIG. 7, reference numeral 700 denotes an optical density obtained by reading the first pattern 501; and numeral 701 denotes a reference output characteristic serving as a target. FIG. 7 shows the result obtained by performing interpolation and a smoothing process for the density data of the read first pattern 501 with 16 tone levels. The optical density of each point Xn (n is a number of 1 to 16, and input signals corresponding to Xn have values of 16, 32, 48, 64, . . . , 256) is denoted by Dn (n=1 to 16), and a shift amount of the actual optical density 700 with respect to the reference characteristic 701 is denoted by ΔDn (n=1 to 16).

A variation ΔDXn in tone is represented by ΔDXn=(Dn−Dn−1)/(Xn−Xn−1)(n=1 to 16, X0=0, and D0=0), and a variation in tone is measured by sequentially calculating ΔDXn at each point (step S3). In step S4, it is determined whether ΔDXn becomes negative, i.e., the measured variation in tone is larger than a predetermined variation. If YES in step S4, since the variation in tone is large, a false outline or the like is expected to occur. Accordingly, the flow advances to step S5 to perform tone correction for the colors of the light and dark toners. On the other hand, if there is no area where the variation ΔDXn in tone exceeds the predetermined variation in step S4, the operation ends without tone correction for the colors of the light and dark toners in step S5. Even if there is no area where ΔDXn becomes negative in step S4, tone correction may be performed for the colors of the light and dark toners in step S5 if there is an area where ΔDXn exceeds the predetermined variation.

Next, a tone correction method where light and dark toner tone correction is performed will be explained.

Figure 8:
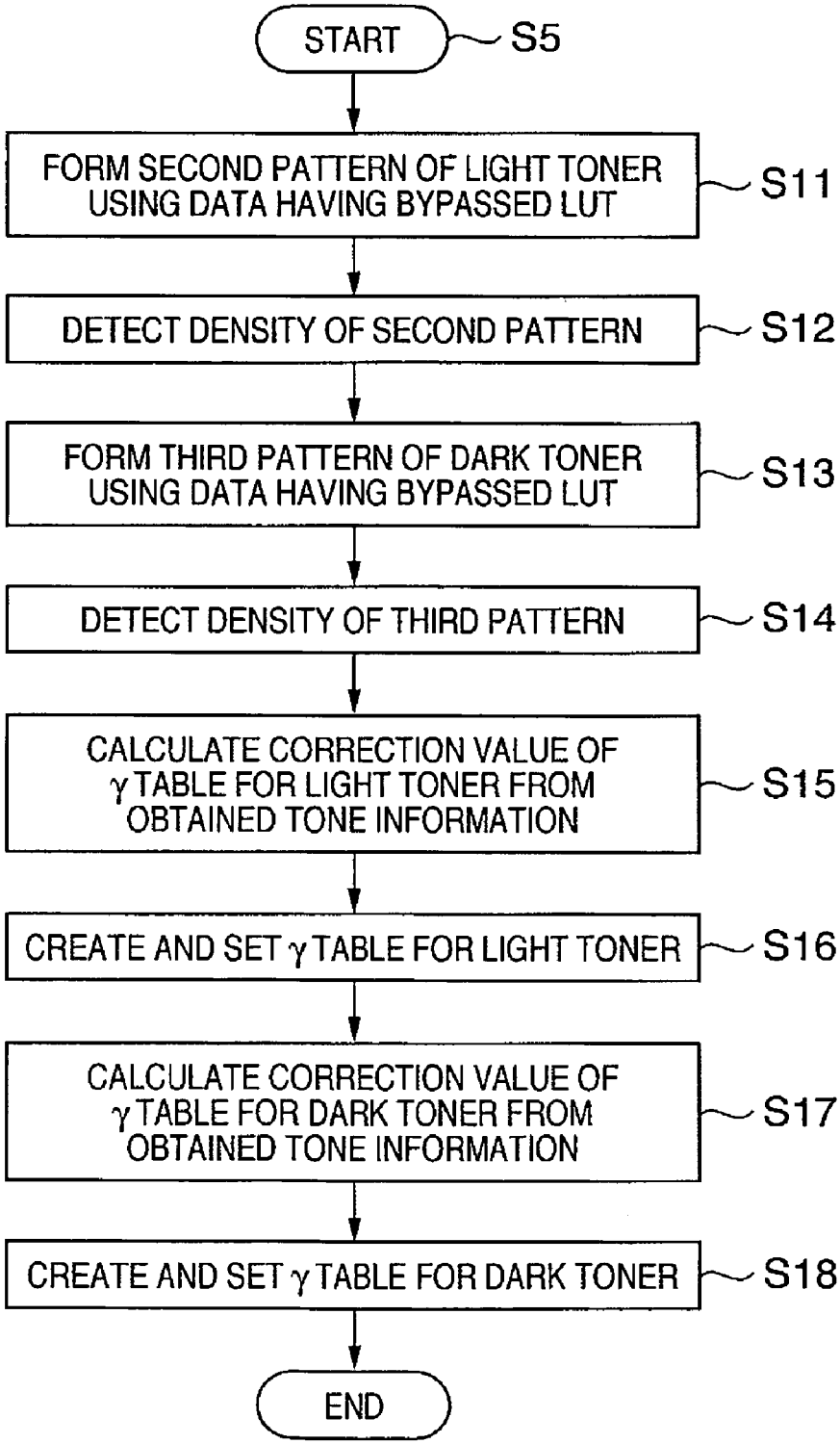
FIG. 8 is a flowchart for explaining light and dark toner tone correction process in step S5 of FIG. 6.

FIG. 8 is a flowchart for explaining the light and dark toner tone correction process in step S5 of FIG. 6.

When a light and dark toner tone correction mode is performed, second pattern data of the light toners is output from the pattern generator 312 to the LUT 311 in order to measure the optical density characteristic of the light toners.

Figure 9:
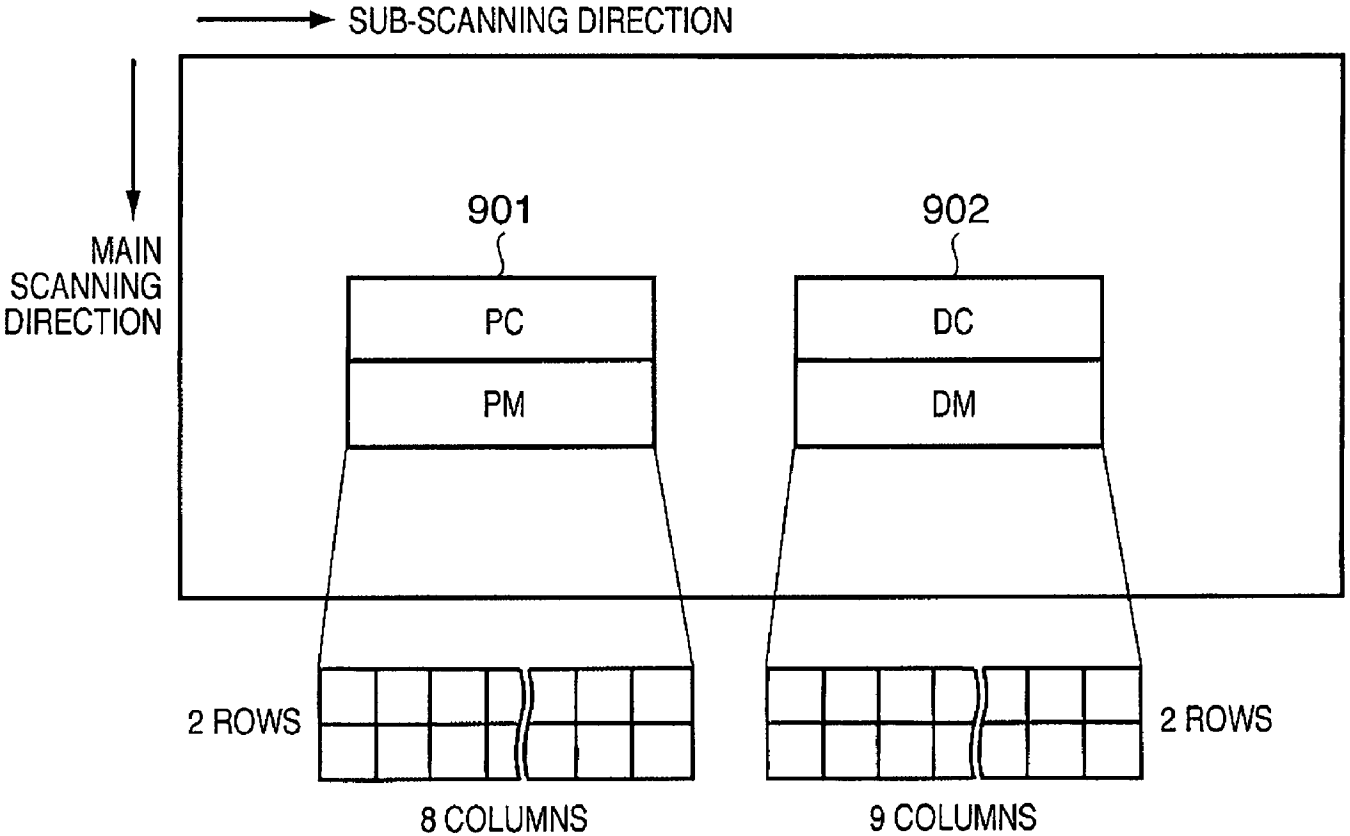
FIG. 9 is a chart for explaining pattern forming using the light toners and dark toners according to this embodiment.
Figure 10:
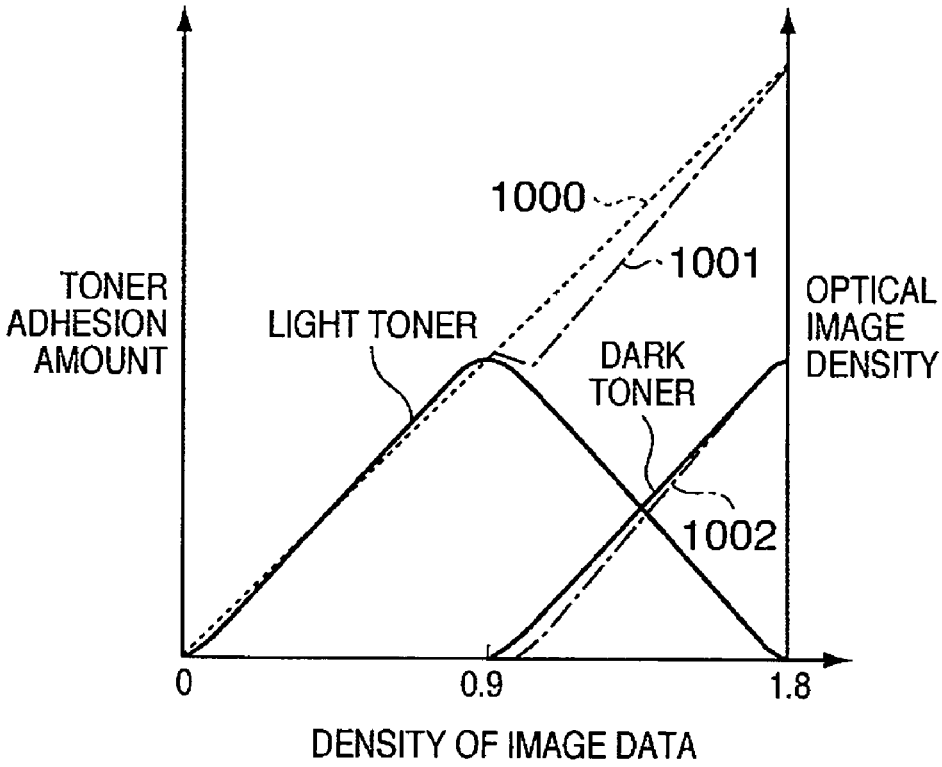
FIG. 10 is a graph for explaining the density of image data, an optical density, and the amount of adhering toner.

As shown in FIG. 9, the pattern data is not converted in the dark and light data generator 320 and LUT 311, and a second pattern 901 is formed on a recording sheet (step S11). Eight input signals Xp (Xp=32, 64, 96, 128, 160, 192, 224, and 255) which form the second pattern 901 of the light toners are generated using the output characteristic of an image signal for the light toners in FIG. 4 so as to correspond to the input signals (Xn=16, 32, 48, 64, . . . , 128) used to calculate the optical density characteristic in FIG. 7. The second pattern 901 thus formed on the recording sheet is read by the density sensors 99 or CCD sensor 34 after fixation in the same manner as that for the first pattern (step S12).

The flow advances to step S13. In step S13, in order to measure the optical density characteristic of the dark toners, the formation (step S13) and reading (step S14) of a third pattern 902 of the dark toners are performed, similarly to the formation and reading of the second pattern 901 of the light toners. Nine input signals Xd (Xd=0, 32, 64, 96, 128, 160, 192, 224, and 255) which form the third pattern 902 of the dark toners are generated using the output characteristic of an image signal for the dark toners in FIG. 13 so as to correspond to the input signals (Xn=128, 144, 160, 176, . . . , 255) used to calculate the optical density characteristic in FIG. 7.

Figure 11:
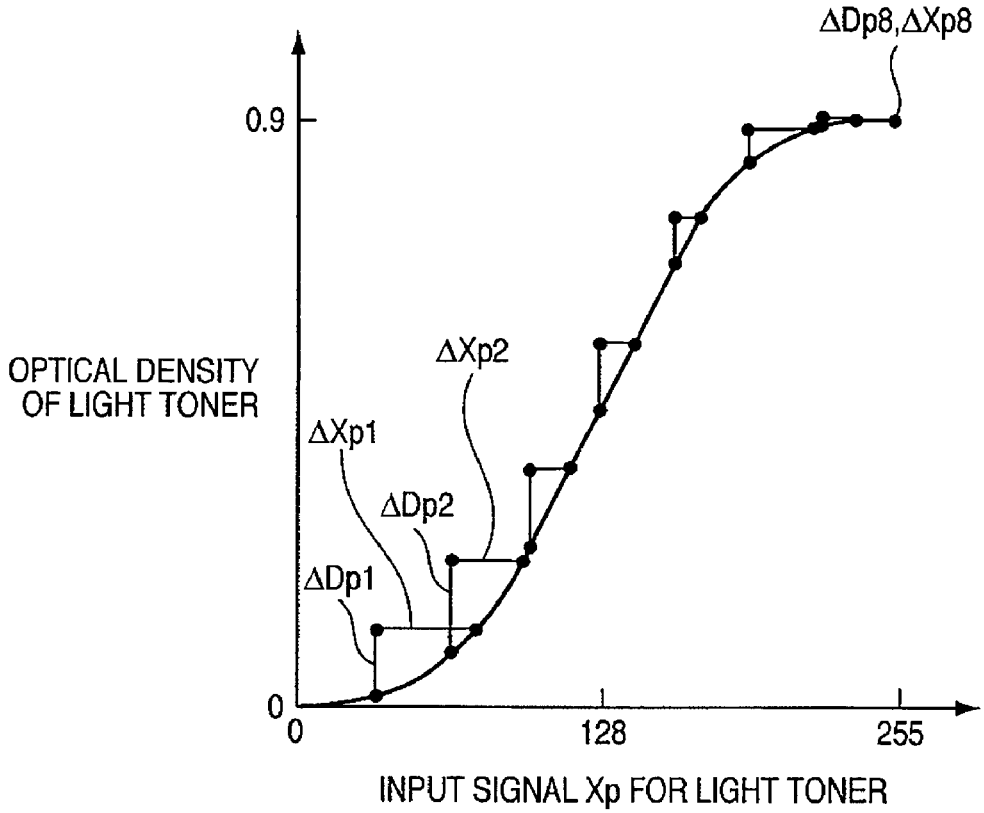
FIG. 11 is a graph showing the optical density characteristic of the light toners obtained by reading a second pattern.

FIG. 11 is a graph showing the characteristic of the optical density of the light toners obtained by reading the second pattern 901 of the light toners. In the image forming apparatus according to this embodiment, assume that adjustment is performed while the optical density is equal to or less than the maximum density of "0.9" of the light toners.

A method of correcting a gamma table for the light toners (step S15) to correct the optical density of the input signal X in the range 0 to 128 will be explained below with reference to a shift amount ΔDn of the optical density and FIGS. 11 and 12.

FIG. 11 is a graph for explaining the characteristic of the optical density of the light toners with respect to an input signal Xp for the light toners.

Since in the case of an input signal in the range 0 to 128, an image is formed of only the light toners as shown in FIG. 4, a light toner density correction value ΔDpn becomes equal to the optical density shift amount ΔDn (n=1 to 8), i.e., ΔDpn=ΔDn (n=1 to 8). An input signal correction value ΔXpn (n=1 to 8) required to correct the density by ΔDpn is calculated from the characteristic of the optical density of the light toners shown in FIG. 11 (step S15).

Figure 12:
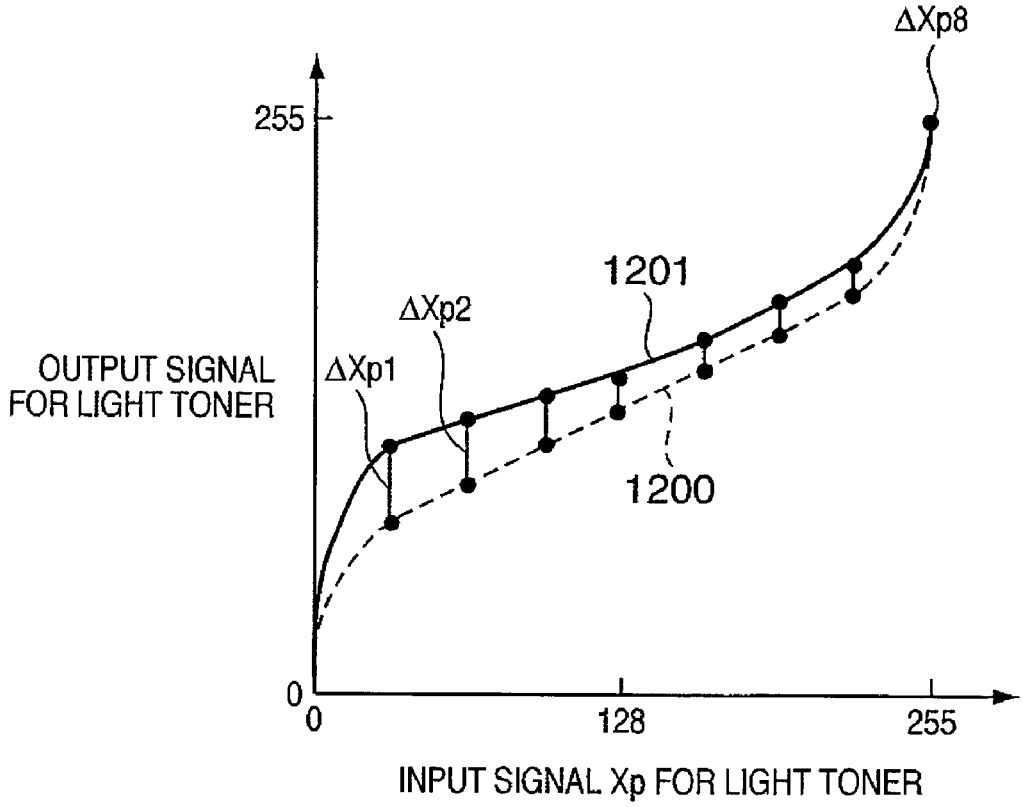
FIG. 12 is a graph for explaining the output y characteristic of each light toner with respect to an input signal Xp for the light toner.

FIG. 12 is a graph for explaining the output γ characteristic of the light toners with respect to the input signal Xp for the light toners.

In FIG. 12, γ table values before correction are indicated by a dotted curved line 1200. The obtained input signal correction value ΔXpn (n=1 to 8) is corrected at 8 points (Xp=32, 64, 96, 128, . . . , 255) of the gamma table indicated by the curved line 1200. The points after the correction are subjected to interpolation and a smoothing process, thereby creating a gamma table with a characteristic indicated by a solid line 1201. By replacing the original gamma table with the newly created gamma table, the density in an area extending from a low-density area to a medium-density area where an input signal Xn has a value of 0 to 128 is corrected, and the tone is improved (step S16).

A method of correcting a gamma table for the dark toners to correct the optical density of the input signal Xn in the range 128 to 255 will be explained with reference to FIGS. 13 and 14.

Figure 13:
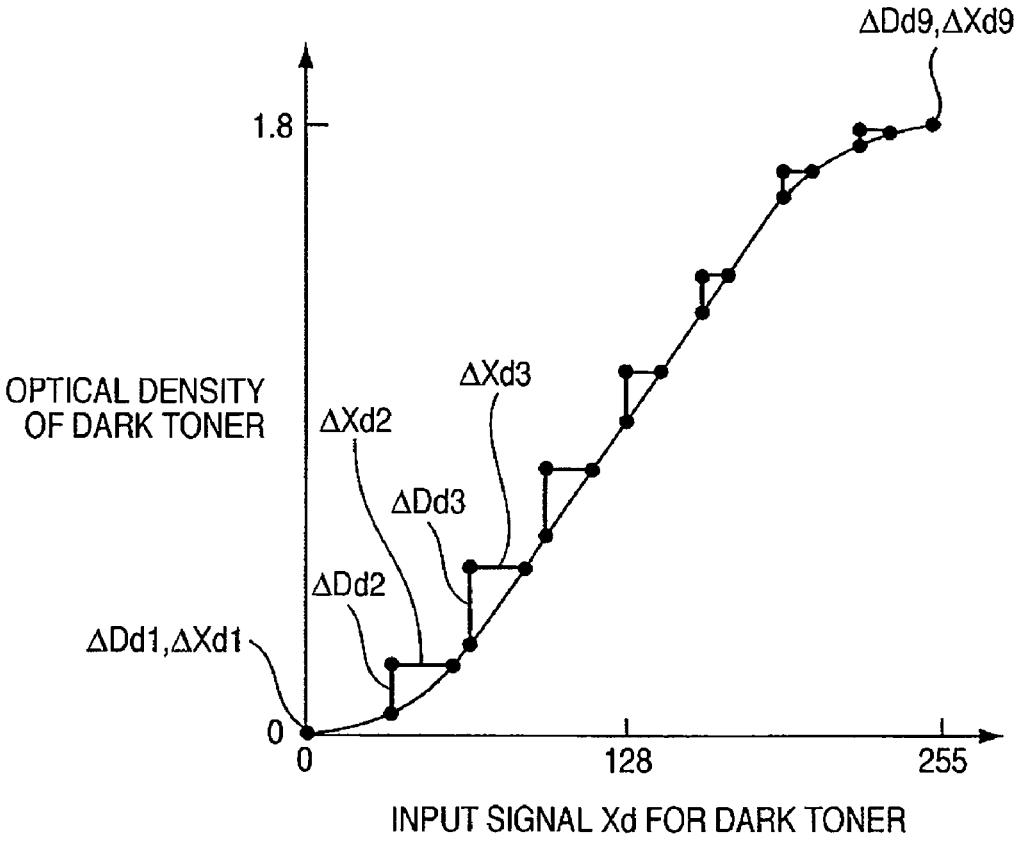
FIG. 13 is a graph for explaining the optical density characteristic of each dark toner obtained by reading the density of a formed tone pattern of the dark toner.

FIG. 13 is a graph for explaining the characteristic of the optical density of the dark toners obtained by reading the density of a formed tone pattern of the dark toners.

In the case of an input signal X in the range 128 to 255, an image is formed using the light toners and dark toners, as shown in FIG. 4. Accordingly, to correct the tone in this area using a gamma table for the dark toners, it is necessary to take into consideration a density to be corrected by the obtained gamma table (1201) for the light toners. Since the output characteristic of an image signal for the light toners in FIG. 4 is symmetrical with respect to an input signal value of "128," a dark toner density correction value ΔDdm can be given by ΔDdm=ΔD(7+m)−ΔD(9−m) (m=1 to 9) where ΔDdm is a dark toner density correction value, ΔD(7+m) is a density correction value ΔDn (n=8 to 16) for a medium- to high-density area, and ΔD(9−m) is a density correction value corrected by the gamma table (1201) for the light toners.

With the above-described calculation, an image signal correction value ΔXdm (m=1 to 9) corresponding to each point is calculated from the optical density characteristic shown in FIG. 13 using the calculated value ΔDdm (step S17).

Figure 14:
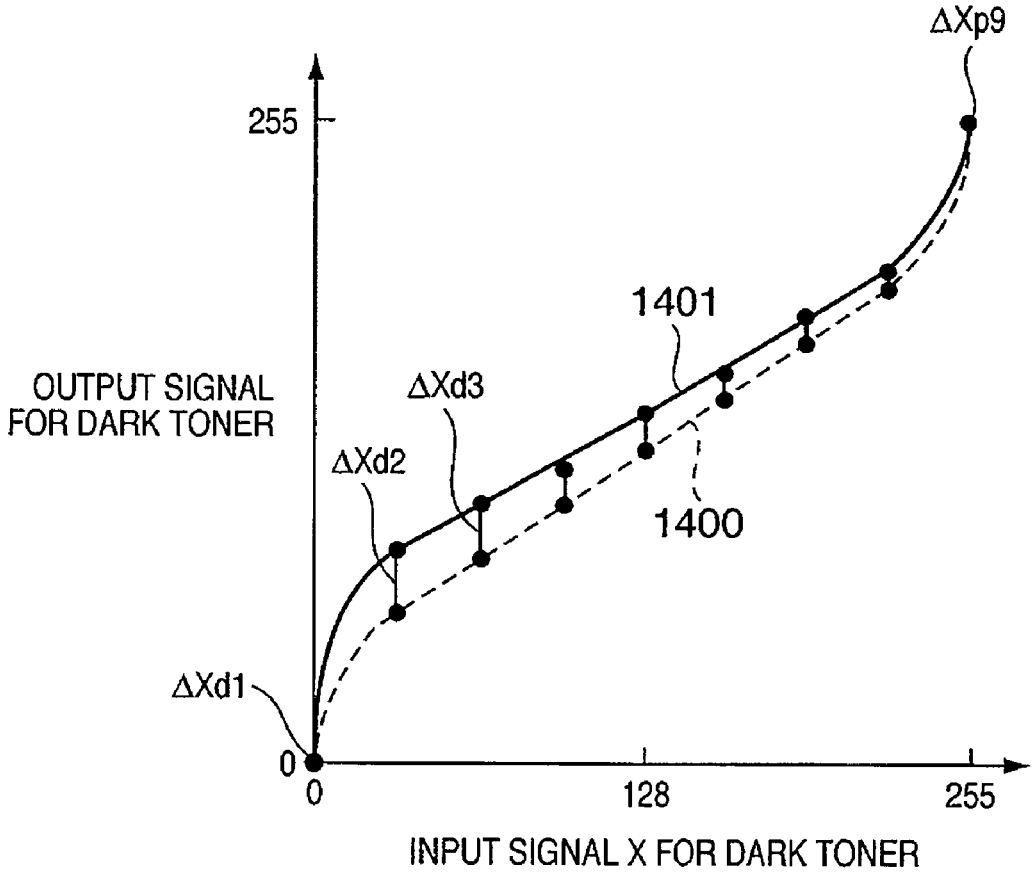
FIG. 14 is a graph for explaining the output gamma characteristic of each dark toner with respect to an input signal Xd for the dark toner.

FIG. 14 is a graph for explaining the output gamma characteristic of the dark toners with respect to the input signal Xd for the dark toners. A table before correction is indicated by a dotted curved line 1400.

In the gamma table (1400) of FIG. 14, an image signal for the dark toners is corrected with an obtained correction value ΔXdn (n=1 to 9) at 9 points (Xd=0, 32, 64, 96, 128, . . . 255). The points after the correction are subjected to interpolation and a smoothing process, thereby creating a gamma table after correction indicated by a solid line 1401. By replacing the gamma table (1400) before the correction with the newly created gamma table (1401) after the correction, the density in an area extending from the medium-density area to a high-density area where the input signal Xd has a value of 128 to 255 is corrected, and the tone of an image is improved (step S18).

In the first embodiment, the optical density is measured using 16 (16-tone-level) patterns having equally spaced values obtained from a 256-tone-level input image signal as the first pattern 501. However, it is also possible to perform tone correction with higher precision by increasing the number of points (tone levels) for pattern forming depending on the output characteristic of the apparatus or adjusting pattern forming intervals.

In an apparatus which forms an image by switching between resolutions depending on the image, by forming patterns with respective resolutions and performing tone correction according to the first embodiment, a good stable image can be output even if the gradation characteristic widely varies from resolution to resolution.

Second Embodiment

The first embodiment has described a tone correction method for a light and dark toner image forming apparatus using two photosensitive bodies. In contrast to this, the second embodiment will explain a case of a tandem-type light and dark toner image forming apparatus which has higher productivity than the image forming apparatus according to the first embodiment.

Figure 15:
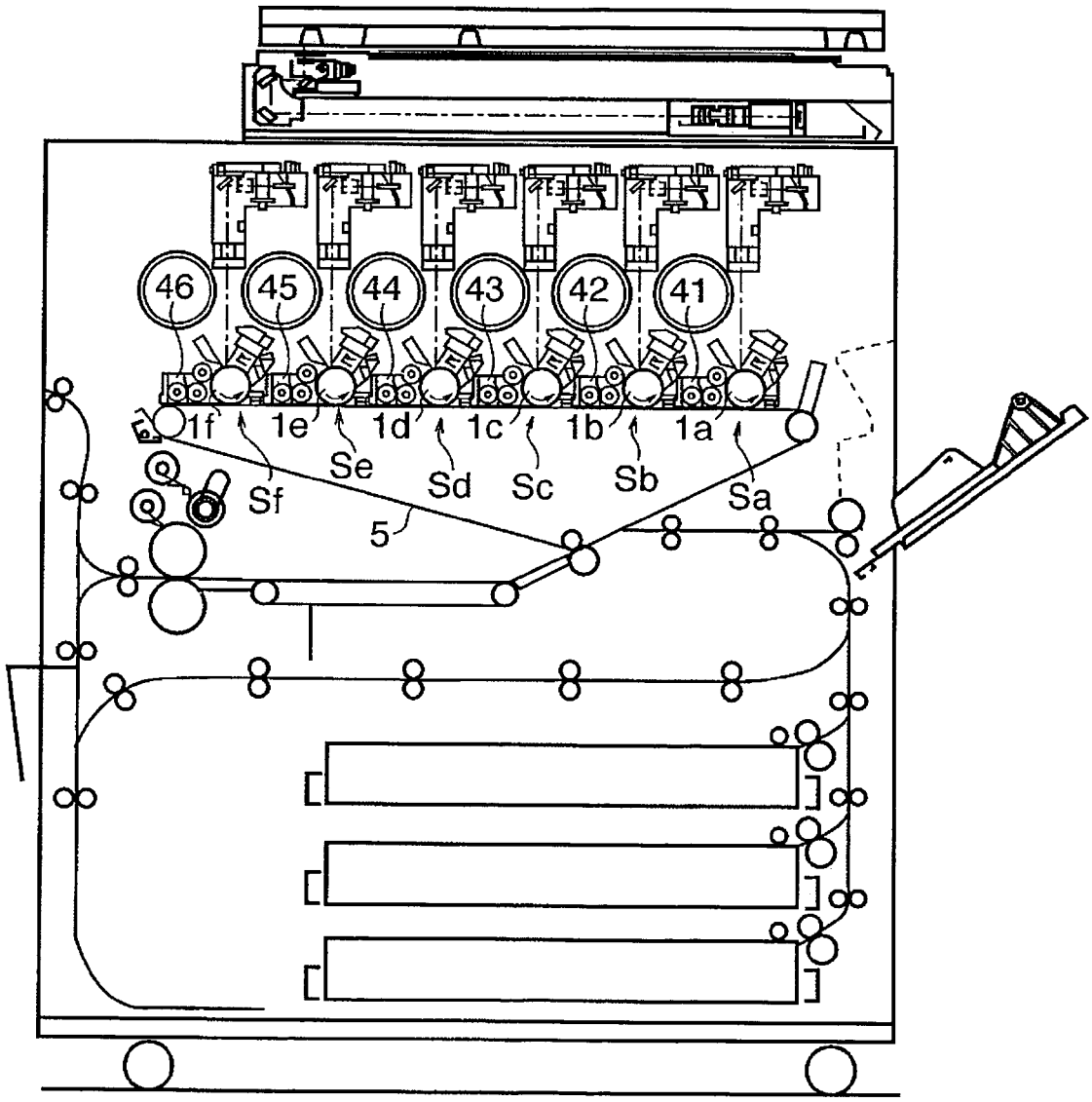
FIG. 15 depicts a view showing a tandem-type image forming apparatus according to a second embodiment of the present invention.

FIG. 15 depicts a tandem-type image forming apparatus according to the second embodiment of the present invention. The image forming apparatus is a tandem-type one which forms an image using image carriers (photosensitive drums) equal in number of the types of toners.

In the tandem-type image forming apparatus, developing units 411, 412, 413, 414, 415, and 416 loaded with developing substances with different spectral characteristics are made to correspond one-to-one to six image carriers 1*a* to 1*f*. Image forming units Sa, Sb, Sc, Sd, Se, and Sf each including a combination of one of the image carriers and one of the developing units are arranged in series. With this tandem method, it is possible to make the image output speed constant even in a case wherein an image forming apparatus of six colors is used as a base, and increase the productivity.

Even the image forming apparatus with this arrangement can perform tone correction according to the first embodiment.

As has been explained above, according to this embodiment, if a variation in density of the first pattern formed using a dark color substance and light color substance with substantially the same hue is equal to or larger than a predetermined amount, tone correction is performed for the colors of light and dark toners. This makes it possible to reduce the downtime of an apparatus due to tone correction and prevent a reduction in productivity.

The present invention is not limited to the above embodiment, and various changes and modifications can be made thereto within the spirit and scope of the present invention. Therefore, to apprise the public of the scope of the present invention, the following claims are made.

CLAIM OF PRIORITY

This application claims priority from Japanese Patent Application No. 2004-354699 filed on Dec. 7, 2004, which is hereby incorporated by reference herein.

What is claimed is:

1. An image forming apparatus having an image forming unit which forms an image using a dark color substance and light color substance with substantially a same hue, comprising:

a pattern forming unit configured to form a first pattern on a recording medium using the dark color substance and light color substance with substantially the same hue by supplying first pattern data to the image forming unit;

a density detection unit configured to detect a density of the first pattern formed on the recording medium by said pattern forming unit;

a correction unit configured to correct conditions for image forming using the dark color substance and light color substance with substantially the same hue in the image forming unit, on the basis of the density of the first pattern detected by said density detection unit and a density of the first pattern data; and a control unit configured to perform control so as to perform correction by said correction unit, in a case where a variation in the density of the first pattern detected by said density detection unit is not less than a predetermined value;

wherein said image forming unit forms an image using the light color substance in a case where a density of image data is not more than a predetermined value, and forms an image using the dark color substance in a case where the density of the image data is not less than the predetermined value.

2. The apparatus according to claim 1, wherein the first pattern data comprises a plurality of pattern data with one of increasing densities and decreasing densities.

3. The apparatus according to claim 1, wherein said pattern forming unit forms a second pattern using the light color substance and a third pattern using the dark color substance by further supplying second and third pattern data to the image forming unit, said density detection unit detects the densities of the second and third pattern formed on the recording medium by said pattern forming unit, and said correction unit determines gamma correction values for the light and dark color substances on the basis of densities of the second and third patterns detected by said density detection unit.

4. The apparatus according to claim 1, wherein the dark and light color substances are dark and light color developing substances, respectively, containing pigments which have equivalent spectral characteristics and are different in amount.

5. A control method for an image forming apparatus having image forming unit that forms an image using a dark color substance and light color substance with substantially a same hue, comprising:

a pattern forming step of forming a first pattern on a recording medium using the dark color substance and light color substance with substantially the same hue by supplying first pattern data to the image forming unit;

a density detection step of detecting a density of the first pattern formed on the recording medium in said pattern forming step;

a correction step of correcting conditions for image forming using the dark color substance and light color substance with substantially the same hue in the image forming unit, on the basis of the density of the first pattern detected in said density detection step and a density of the first pattern data;

a control step of performing control so as to perform correction in said correction step, in a case where a variation in the density of the first pattern detected in said density detection step is not less than a predetermined value; and an image forming step of forming an image using the light color substance in a case where a density of image data is not more than a predetermined amount, and forming an image using the dark color substance in a case where the density of the image data is not less than the predetermined amount.

6. The method according to claim 5, wherein the first pattern data comprises a plurality of pattern data with one of increasing densities and decreasing densities.

7. The method according to claim 5, wherein in said pattern forming step, a second pattern using the light color substance and a third pattern using the dark color substance are formed by further supplying second and third pattern data to the image forming unit, in said density detection step, the densities of the second and third pattern formed on the recording medium by said pattern forming unit are detected, and in said correction step, gamma correction values for the light and dark color substances are determined on the basis of densities of the second and third patterns detected in said density detection step.

8. The method according to claim 5, wherein the dark and light color substances are dark and light color developing substances, respectively, containing pigments which have equivalent spectral characteristics and are different in amount.

* * * * *

UNITED STATES PATENT AND TRADEMARK OFFICE

CERTIFICATE OF CORRECTION

PATENT NO. : 7,359,652 B2
APPLICATION NO. : 11/295226
DATED : April 15, 2008
INVENTOR(S) : Hirokazu Kodama et al.

It is certified that error appears in the above-identified patent and that said Letters Patent is hereby corrected as shown below:

Title Page
In Section (75) Titled "Inventors" the First Inventor's name should be amended to read as follows:

--Hirokazu KODAMA--

In Section (75) Titled "Inventors" the Inventor's City of residence should be amended to read as follows:

--Ryugasaki-shi (JP);--
--Abiko-shi (JP)--

In Section (56) Titled "References Cited" the Patentee of the U.S. Patent Document 6,879,788 B2 should be amended to read as follows:

--6,879,788 B2* 4/2005 Ito, et al.--

Signed and Sealed this

Fifth Day of August, 2008

JON W. DUDAS
*Director of the United States Patent and Trademark Office*